US008344626B2

(12) United States Patent
Marchesin et al.

(10) Patent No.: US 8,344,626 B2
(45) Date of Patent: Jan. 1, 2013

(54) ELECTRON BEAM TUBE OUTPUT TRANSITION INCLUDING A RECTANGULAR TO CONICAL WAVEGUIDE TRANSITION WITH CONICAL INTERNAL PROPAGATION SURFACES

(75) Inventors: Rodolphe Marchesin, Gif sur Yvette (FR); David Bariou, Palaiseau (FR); Jean-Luc Piquet, Les Ulis (FR); Serge Agogue, Bures sur Yvette (FR)

(73) Assignee: Thales, Neuilly sur Seine (FR)

( * ) Notice: Subject to any disclaimer, the term of this patent is extended or adjusted under 35 U.S.C. 154(b) by 242 days.

(21) Appl. No.: 12/639,595

(22) Filed: Dec. 16, 2009

(65) Prior Publication Data

US 2010/0295636 A1 Nov. 25, 2010

(30) Foreign Application Priority Data

Dec. 23, 2008 (FR) ..... 08 07393

(51) Int. Cl.
*H01J 23/36* (2006.01)
*H01P 1/16* (2006.01)

(52) U.S. Cl. ..... 315/39.3; 333/21 R; 333/252

(58) Field of Classification Search ..... 333/21 R, 333/35, 252; 315/39.3, 39.53
See application file for complete search history.

(56) References Cited

U.S. PATENT DOCUMENTS 2,830,273 A * 4/1958 Whitehead et al. ..... 333/21 R
3,818,383 A * 6/1974 Willis ..... 333/21 R
5,461,283 A * 10/1995 Thornber et al. ..... 315/39.53
2003/0160663 A1 8/2003 Van Meter
2008/0136565 A1 6/2008 Paynter

FOREIGN PATENT DOCUMENTS

CA 823797 A 9/1969
EP 1223636 A1 7/2002
EP 1933412 A2 6/2008
GB 1280842 A 7/1972

* cited by examiner

*Primary Examiner* — Benny Lee
(74) *Attorney, Agent, or Firm* — Stroock & Stroock & Lavan LLP

(57) ABSTRACT

The invention relates to a microwave output transition for a high-power electron tube comprising a body (78) of tubular shape, along a longitudinal axis ZZ', having two ends (80, 90), a passage (79) between the two ends that has internal surfaces for propagating electromagnetic waves, one of the ends (90), in the form of a circular cylindrical tube, comprising a conical internal propagation surface (130) and the other end (80), in the form of a tube of rectangular cross section, having two long sides (84, 85) and two short sides (86, 87) perpendicular to the long sides, the passage having two plane internal propagation surfaces (120, 122) parallel to the long sides (84, 85) and two other plane internal surfaces (124, 126) parallel to the short sides (86, 87).

Each of the plane internal propagation surfaces (120, 122) parallel to the long sides (84, 85) is joined to the conical internal propagation surface (130) via a respective curved connecting surface (132, 133) having bidirectional radii of curvature.

9 Claims, 5 Drawing Sheets

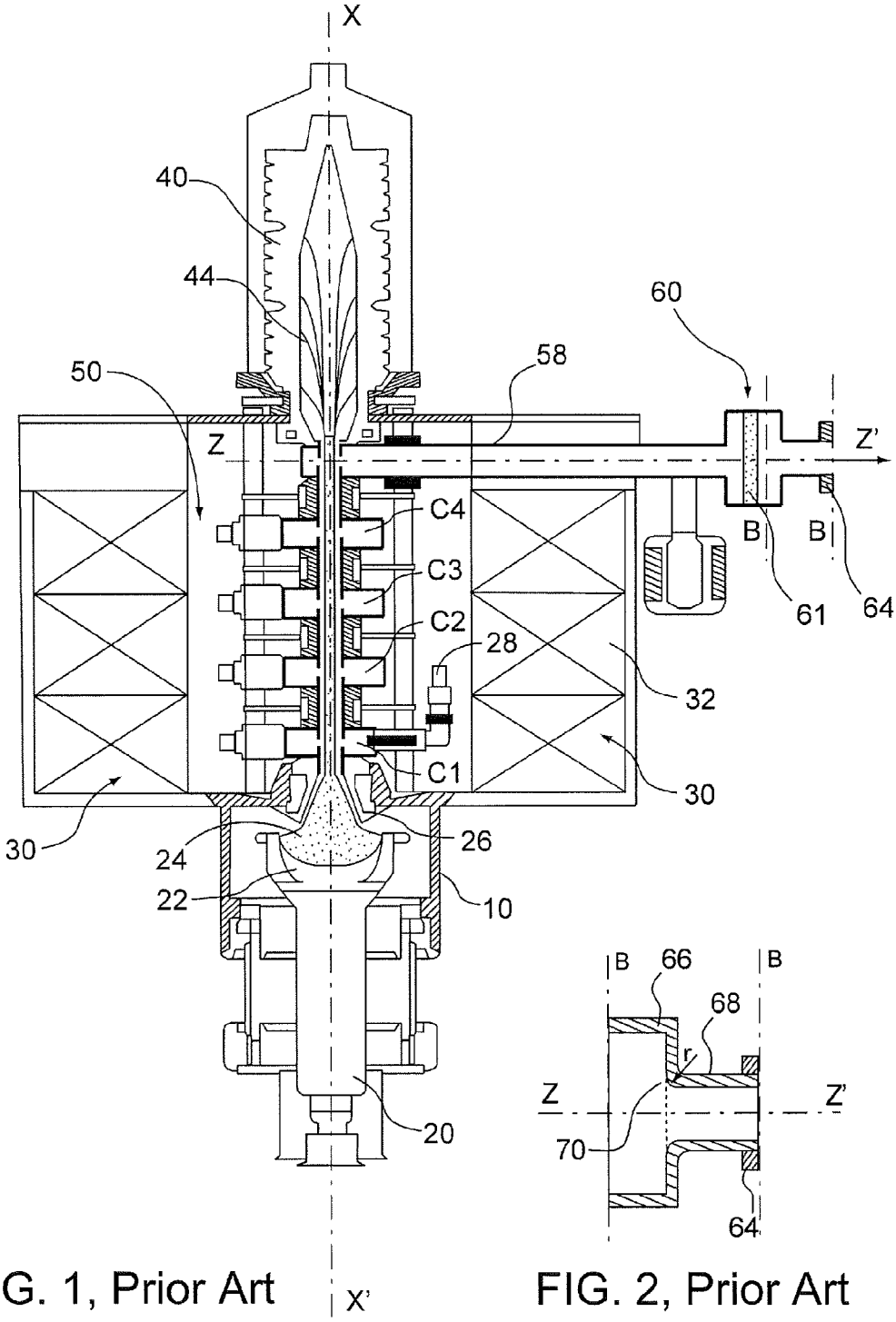
FIG. 1, Prior Art
FIG. 2, Prior Art

ELECTRON BEAM TUBE OUTPUT TRANSITION INCLUDING A RECTANGULAR TO CONICAL WAVEGUIDE TRANSITION WITH CONICAL INTERNAL PROPAGATION SURFACES

CROSS REFERENCE TO RELATED APPLICATIONS

The present application claims priority to French Patent Application Serial No. 0807393, filed Dec. 23, 2008, which is incorporated by reference in its entirety.

FIELD OF THE INVENTION

The present invention relates to a transition between a radiofrequency output of a high-power microwave tube and a waveguide.

BACKGROUND OF THE INVENTION

High-power microwave electron tubes, such as klystrons operating in the L-band, i.e. in a frequency band from 1 to 2 GHz, comprise at least one high-power RF output intended to be connected to a waveguide in order to transmit the RF power delivered by the tube to a microwave use circuit.

The output cavity of the klystron is connected to the waveguide via a microwave window transparent to the electromagnetic waves. The microwave window isolates the inside of the tube which is under vacuum from the outside, which is possibly under pressure of a gas. Furthermore, a transition after the microwave window is necessary for connecting the output of the window, which is of circular cylindrical shape, to the waveguide of rectangular cross section.

Conventional klystrons are amplifiers essentially having a microwave structure intended to amplify a microwave applied to an RF input of the tube. Amplification takes place by converting the kinetic energy of one or more electron beams passing through said structure into electromagnetic energy.

FIG. 1 shows a simplified diagram of a single-beam klystron of the prior art, which includes a vacuum chamber 10 along a longitudinal axis XX', the klystron having:

- an electron gun 20 with a biased cathode 22 emitting a continuous or pulsed electron beam 24, the electrons being accelerated by an anode 26, along the XX' axis;
- an input resonant cavity C1 for modulating the electron density of the beam when a radiofrequency (RF) signal is injected thereinto via an RF input 28 of the tube;
- a circuit 30 for focusing (or confining) the electron beam along the XX' axis, produced either from permanent magnets or by solenoids 32;
- an electron collector 40, for collecting the electrons 44 of the electron beam, making it possible to receive most of the electrons emitted by the cathode 22 of the tube and to dissipate their residual kinetic energy after they are passed through the microwave structure; and
- a resonant circuit 50, located between the anode 26 and the electron collector 40, having the function of converting some of the kinetic energy of the electrons in the beam in the resonant circuit to RF energy at the resonant frequency of the circuit. The resonant circuit 50 is also termed an interaction structure. The resonant circuit forms an integral part of the klystron and comprises a series of resonant cavities C1, C2, C3, C4, in the microwave structure.

The klystron further includes at least one RF power output 58 in the form of a waveguide connected to an output transition 60 (FIG. 1) for extracting, to the outside of the tube, the amplified RF power along an axis ZZ'.

The output transition 60, in this embodiment of a klystron, includes a ceramic window 61 for sealing between the inside of the tube under vacuum and an application waveguide (not shown in FIG. 1) under pressure of a gas and the connection by means of a flange 64 to the waveguide.

In the case of a klystron with a high output power, the waveguide used is, for example in the L-band, a WR650 waveguide of rectangular cross section.

FIG. 2 shows a partial view (delimited by dashed lines B) of an output transition of the prior art of the klystron shown in FIG. 1.

The output transition 60 includes, on the output side of the klystron, via a separating window (not shown in FIG. 2), a cylindrical portion 66 of circular cross section connected to the output of the klystron and, on the opposite side, another portion 68 in the form of a tube of rectangular cross section that includes the flange 64 for connection to the application waveguide. Inside the transition, the cylindrical surface and the plane surfaces of the rectangular section are joined by a fillet 70 of radius r.

The microwave output circuit is exposed to intense electric fields through the passage of the RF power output by the high-power klystron and notably in the output transition 60. If the electric field generated by the RF power wave in the output transition produces, between certain points (or electrodes) of the transition, a voltage above the breakdown voltage of said transition, then an electric arc is produced, which may degrade the klystron.

The output of the klystron includes arc detectors, but despite having fast response times, these detectors can only be triggered at the moment when the breakdown occurs, which nevertheless limits the behavior of the arc over time.

The breakdown resistance of the power output circuit of the klystron depends on various parameters, such as the standing wave ratio in the output circuit, the harmonics of the RF signal, the temperature of the transition and of the waveguide, as well as the influence of other elements present in the output circuit, such as measurement components or couplers, but also particles suspended in the gas of the pressurized circuit which reduce the arc initiation resistance.

To avoid arcs being initiated in the RF output circuit of the tube, it is important for the critical breakdown threshold not to be exceeded. The electric field in the output circuit corresponding to this limit is what is called the electrical strength or breakdown strength of the gas. This breakdown strength depends on the gas pressure multiplied by the distance between those parts of the output circuit liable to generate the arc (equivalent to electrodes) and on the material of those parts of the circuit.

In general, the arcs are produced notably in the transition connecting the output of the tube to the waveguide inside the transition, at the fillet 70 between the cylindrical portion 66 and the rectangular portion 68 of the transition. One weakness of this type of transition of the prior art shown in FIG. 2 is that of having a region with an electric field locally increased because of the geometry of this zone, the electric field being able to locally exceed the breakdown threshold. The electromagnetic field in the transition reaches a maximum level at the fillet 70 in a central portion of this fillet.

The electric arc resistance of this type of transition of the prior art is limited because of a small fillet radius r, for example around 2 to 3 mm in the L-band, between the internal surface of the cylindrical portion 66 and that of the rectangular portion 68.

The breakdown threshold in a closed volume, through which an electromagnetic wave travels, depends on the composition of the gas used but also on the pressure. In the case of dry air, a maximum electric field of the order of 1 kV/mm is usual in the RF power circuit.

For example, under specified power and frequency conditions, the electric field in the transition may locally be twice the electric field in the waveguide. As a result, the transition becomes the element of the microwave circuit that limits the RF power that can be transmitted, because of the risk of breakdown.

To increase the breakdown threshold of this type of transition of the prior art, one solution consists in using a gas such as sulphur hexafluoride or $SF_6$, under pressure in the transition and in the application waveguide.

The microwave transition 60 and the application waveguide must be pressurized with $SF_6$ or an equivalent type gas. Pressurization with this type of $SF_6$ gas makes it possible to transmit a peak output power from the klystron that is much higher than for pressurization with air or nitrogen.

However, the use of $SF_6$ gas for the pressurization has drawbacks. Specifically, $SF_6$ is a greenhouse gas and maintenance of the output circuit, either to pressurize it or to depressurize it, requires precautions to be taken in order to prevent the gas from escaping into the atmosphere.

A significant procedure must be followed so as to prevent this gas from leaking into the atmosphere, such as the use of bottles for collecting the gas in the output circuit of the klystron and the draining of the circuit by pressurizing the circuit with another gas that does not have these drawbacks.

Furthermore, the gas $SF_6$, although harmless to personnel when it is pure, may subsequently become harmful when it is being replaced after use in the output circuit. This is because repetitive breakdowns in the RF output circuit produce, owing to the initially pure $SF_6$ gas decomposing, other gases which are themselves harmful.

SUMMARY OF THE INVENTION

To alleviate the drawbacks of the microwave power transitions of the prior art, the invention provides a microwave output transition for a high-power electron tube comprising a body of tubular shape, along a longitudinal axis ZZ', having two ends, a passage between the two ends that has internal surfaces for propagating electromagnetic waves, one of the ends, in the form of a circular cylindrical tube, comprising a conical internal propagation surface and the other end, in the form of a tube of rectangular cross section, having two long sides and two short sides perpendicular to the long sides, the passage having two plane internal propagation surfaces parallel to the long sides and two other plane internal surfaces parallel to the short sides, characterized in that each of the plane internal propagation surfaces parallel to the long sides is joined to the conical internal propagation surface via a respective curved connecting surface having bidirectional radii of curvature.

Advantageously, the bidirectional radii of curvature are of variable length.

In one embodiment, the bidirectional radii of curvature comprise radii of horizontal curvature, rotating about a respective rotation axis parallel to the short sides of the rectangular end of the body and radii of vertical curvature, rotating about a respective rotation axis parallel to the long sides of said rectangular end of the body.

In another embodiment, the two curved surfaces for connecting the plane internal propagation surfaces, which are parallel to the long sides, to the conical internal propagation surface are symmetrical on either side of the ZZ' axis.

In another embodiment, a radius of vertical curvature Rvc in a plane passing through the ZZ' axis of the body is longer than a first or last radius of vertical curvature in its respective plane perpendicular to the long sides of the rectangular end passing through the plane internal surfaces of the short sides of the rectangular section, these first and last radii of vertical curvature, which are equal in value, being the shortest of the radii of vertical curvature of the two internal surfaces for connection with the internal surfaces parallel to the long sides of the rectangular end.

In another embodiment, the body of the transition includes a central portion between the end in the form of a tube of rectangular cross section and the end in the form of a circular cylindrical tube, the central portion having external surfaces in contact with the surrounding medium, on the one hand, two plane external connecting surfaces in respective inclined planes that are symmetrical with respect to a plane passing through the ZZ' axis parallel to the long sides of the rectangular end of the body and, on the other hand, two other plane external connecting surfaces that are symmetrical on either side of another plane passing through the ZZ' axis and that are parallel to the short sides of the rectangular end of the transition.

In another particular embodiment, the dimensions of the body of the transition are:

- length is 99 mm along the ZZ' axis;
- the circular end has a diameter of 205 mm;
- the conical internal surface is a cone an apex angle 135°;
- the internal rectangular section of the rectangular end has a height 82 mm and a width 165 mm;
- the radius of vertical curvature in the plane perpendicular to the ZZ' axis and passing through this axis, is 60 mm.

In another embodiment, the transition includes a connecting flange fastened to the rectangular end of the body and a circular cylindrical separating window fastened to the circular end of said body.

The invention also relates to an electron tube chosen from klystrons and TWTs, or other high-power microwave tubes, characterized in that it electron tube comprises an RF output transition according to the invention.

The main transition objective according to the invention is to make it possible to use, in the RF power output circuit of a tube, a pressurization gas having no greenhouse effect and that is harmless to maintenance personnel, such as air or nitrogen, while still obtaining a sufficient breakdown strength in the transition.

The secondary objective is, for example, to reduce the level of breakdown for a given output power and for a given pressurization gas.

BRIEF DESCRIPTION OF DRAWINGS

The invention will be better understood from the exemplary embodiments of transitions according to the invention and of a klystron fitted with the transition, with reference to the indexed drawings, where like features are denoted by the same reference numbers in the drawings, and in which:

FIG. 1, already described, shows a simplified diagram of a klystron of the prior art;

FIG. 2, already described, shows a partial view of an output transition of the prior art of the klystron shown in FIG. 1;

DETAILED DESCRIPTION OF EMBODIMENT

Figure 3B:
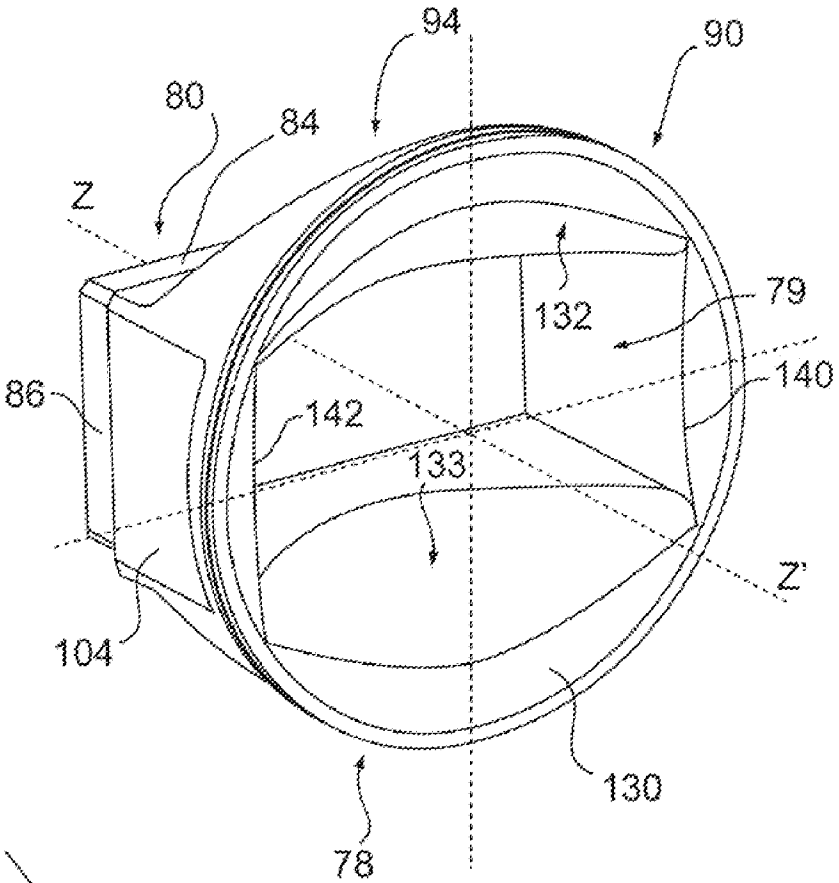
FIGS. 3*a* and 3*b* show two line diagrams in perspective of the body of a transition according to the invention.
Figure 3A:
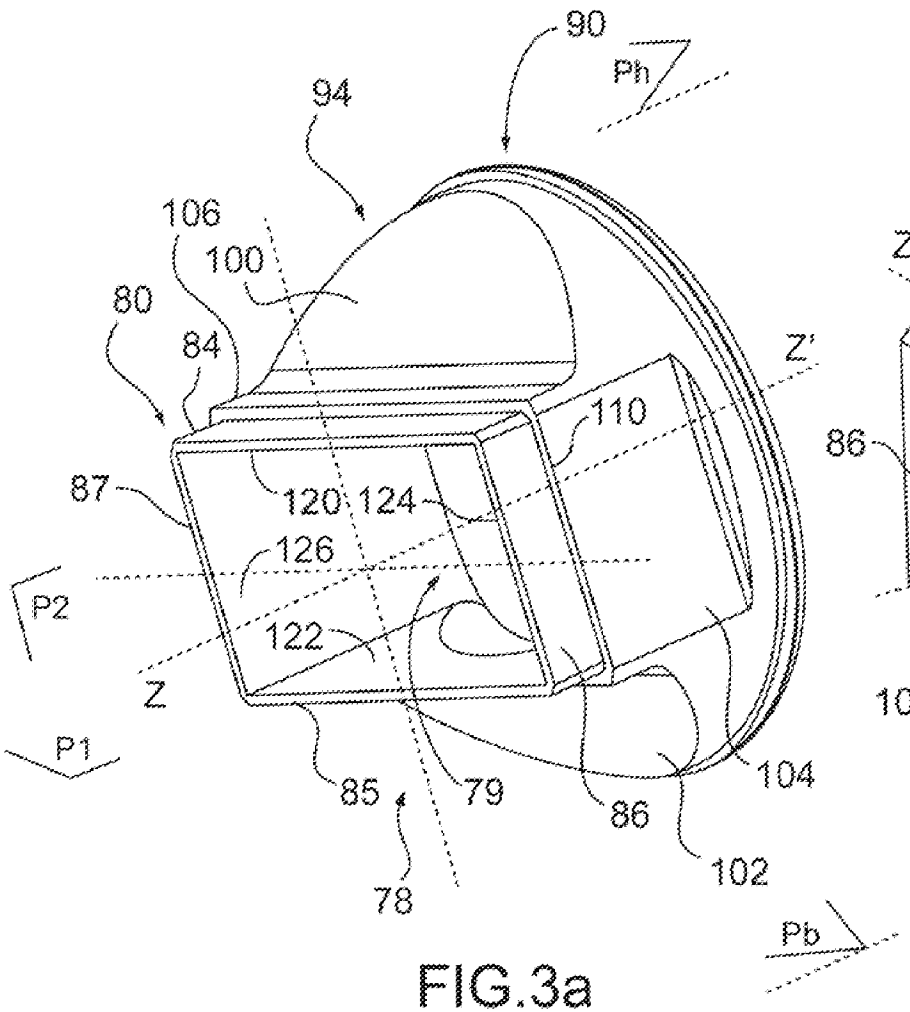

FIGS. 3*a* and 3*b* show two line diagrams in perspective of the body of a transition according to the invention.

The transition according to the embodiment of the invention comprises a body 78 of tubular shape, along a longitudinal axis ZZ', having two ends and a passage 79 between the two ends. One of the ends 80 is in the form of a tube of rectangular cross section, having two parallel long sides 84, 85 (FIG. 3*a*) and two short sides 86, 87 FIG. 3*a*) perpendicular to the long sides, the other end 90 being in the form of a circular tube.

The end 80 of rectangular cross section is intended to receive a connecting flange (not shown in the figure) for connection to an application waveguide, likewise of rectangular cross section; the circular end 90 of which is intended to be connected to the RF output of the electron tube.

The body of the transition further includes a central portion 94 between the rectangular tubular end 80 and the circular tubular end 90.

The body of the transition comprises external surfaces in contact with the ambient medium and, in the passage 79, internal surfaces for propagating RF electromagnetic waves output by the tube into the waveguide.

As shown in FIG. 3*a*, the external surfaces of the body of the transition comprise, in the central portion 94 of the body, on the one hand, two plane external surfaces 100, 102 for connection to the ends of the body, in respective inclined planes Ph, Pb that are symmetrical with respect to a plane P1 passing through the ZZ' axis parallel to the long sides 84, 85 of the rectangular end 80 of the body 78 and, on the other hand, two other plane external connecting surfaces 104, 106 for connection to said ends of the body, which are symmetrical on either side of another plane P2 passing through the ZZ' axis and that are parallel to the short sides 86, 87 of the rectangular end of the transition.

The shape of the two symmetrical inclined plane external connecting surfaces 100, 102 results from the intersection of the inclined planes Ph, Pb passing through these surfaces and of the circular cylindrical end 90 of the body.

The connection between the rectangular end 80 of the body and the central portion 94 has a shoulder 110 in a plane perpendicular to the ZZ' axis, forming a stop for positioning a connecting flange (not shown in the figures) for connection to a waveguide.

The internal volume of the passage 79, bounded by the internal surfaces of the body 78, determines the propagation of the electromagnetic waves in the transition. These internal surfaces comprise, on the side of the rectangular end of the body, two plane internal surfaces 120, 122 parallel to the long sides 84, 85 of the waveguide and two other plane internal surfaces 124, 126 parallel to the short sides 86, 87 and, on the side of the circular cylindrical end 90, a conical internal propagation surface 130 (FIG. 3*a*).

The conical internal surface 130 has two intersecting edges 140, 142, as shown in FIG.3*b*, which intersect with the plane internal surfaces 124, 126 parallel to the short sides 86, 87 of the rectangular end 80 of the body.

Each of the two plane internal surfaces 120, 122 parallel to the long sides 84, 85 of the rectangular end of the body is connected to the conical internal surface 130 of the circular cylindrical end 90 via a respective curved surface 132, 133, as shown in FIG. 3*b*, which is symmetrical on either side of the ZZ' axis having, according to a main feature of the invention, bidirectional radii of curvature of variable length.

The angles of inclination to the ZZ' axis of the two inclined plane external connecting surfaces 100, 102 makes it possible to join the internal surfaces of the two ends of the transition by curved surfaces 132, 133 with fillet radii that are much larger than the fillet radii r of the transitions of the prior art, as shown in FIG. 2.

Figure 4B:
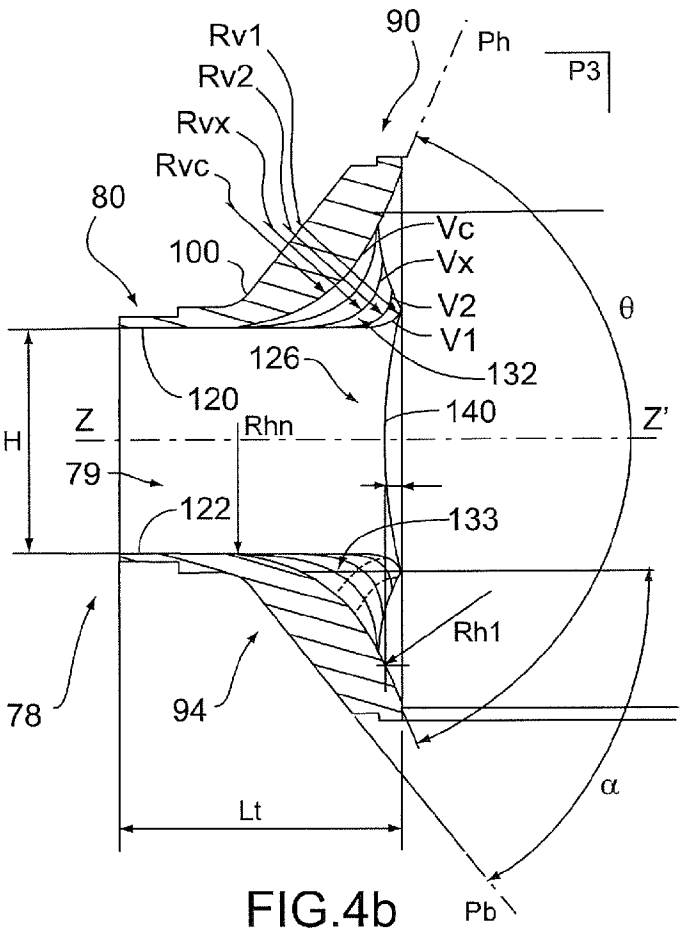
FIG. 4*b* is an axial sectional view of the body of the transition shown in FIGS. 3*a* and 3*b;*
Figure 4A:
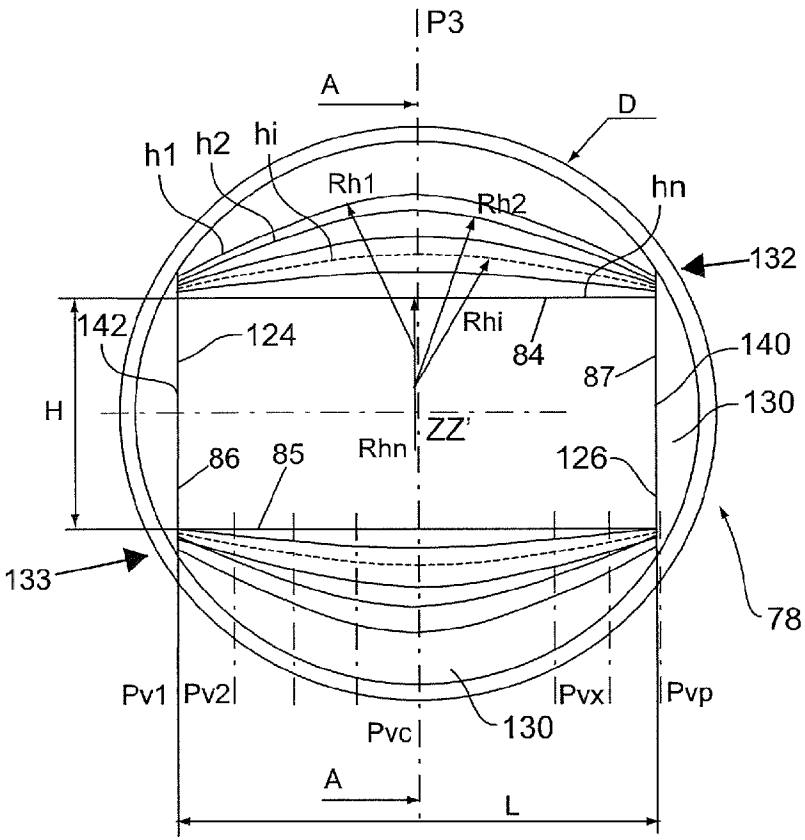
FIG. 4*a* shows a front view of the circular cylindrical portion of the body of the transition shown in FIGS. 3*a* and 3*b;*

FIG. 4*a* shows a front view of the circular cylindrical portion 90 of the body of the transition in FIGS. 3*a* and 3*b* showing the curved connecting surfaces 132, 133 in the form of curves of horizontal level h1, h2, hi, . . . hn of the curved surface, i being an integer between 1 and n, n being the number of curves of horizontal level, and FIG. 4*b* shows an axial sectional view of the body of the transition in FIGS. 3*a* and 3*b*.

FIG. 4*b* shows a sectional view on AA (see FIG. 4*a*) in a plane P3 perpendicular to the long sides 84, 85 (shown in FIG. 4*a*) of the rectangular end of the body of the transition passing through the longitudinal axis ZZ'.

According to FIG. 4*a*, each of the curves of horizontal level h1, h2, hi, . . . hn of the edges of the connecting surfaces 132, 133 is inscribed within a curved portion having a respective radius of horizontal curvature Rh1, Rh2, . . . Rhi, . . . Rhn, each of said radii of horizontal curvature rotating about a respective rotation axis parallel to the short sides 86, 87 of the rectangular end 80 (FIG. 4*b*) of the body.

The radii of horizontal curvature are of variable length and of variable center of rotation in planes perpendicular to the short sides 86, 87 (shown in FIG. 4*a*) of the rectangular section of the body depending on the curve of horizontal level h1, h2, hi, . . . hn in question.

This is because a first radius of horizontal curvature Rh1 will have a finite length determining the horizontal level h1, the intersection between the conical internal surface 130 and the respective curved surface 132, 134. The last radius of horizontal curvature Rhn will have an infinite length determining the last horizontal level hn, the intersection between the curved surface 132, 133 and this time a respective plane internal surface 120, 122 (FIG. 4*b*) of the long sides of the rectangular section of the body. The set of intermediate radii of horizontal curvature Rh1, Rh2, . . . Rhi, . . . Rhn, among which is the intermediate radius of horizontal curvature Rhi of rank i, determines the shape of the curved surface 132, 133.

FIG. 4*b* shows curves of vertical level v1, v2, . . . vx, . . . vc of the internal curved surface in a respective plane of cutting Pv1, Pv2, . . . , Pvc, . . . Pvx, . . . Pvp (FIG. 4*a*) which are perpendicular to the long sides 84, 85 (FIG. 4*a*) of the rectangular ends 80 of the body, x being an integer between 1 and p being the number of curves of vertical level.

Referring to FIG. 4*b*, each of the curves of vertical level v1, v2, . . . vx, . . . vc at the edges of the internal connection surface is inscribed within a curved portion having a respective radius of vertical curvature Rv1, Rv2 . . . , Rvx, . . . Rvc, each of the radii of vertical curvature rotating about a respective rotation axis parallel to the long sides 84, 85 (FIG 4*a*) of the rectangular end 80 of the body.

The radii of vertical curvature are of variable length and of variable centre of rotation in the planes Pv1, Pv2, . . . Pvx, . . . Pvp parallel to the short sides of the rectangular section of the body according to the curvature of vertical level v1, v2, . . . vx, . . . vc in question.

This is because the radius of vertical curvature Rvc in the plane P3 passing through the ZZ' axis of the body is longer than the first Rv1 or last Rvp radius of vertical curvature in their respective planes perpendicular to the long sides of the end passing through the internal surfaces 124, 126 of the short sides of the rectangular section. These first Rv1 and last Rvp radii of vertical curvature, which are equal in value, are the shortest of the radii of vertical curvature of the two internal surfaces 132, 133 for connection with the internal surfaces 120, 122 parallel to the long sides 84, 85 of the rectangular end of the body (shown in FIG. 3*a*).

In the transition according to an embodiment of the invention, the distance between two symmetrical points on the curved connection surfaces, in planes perpendicular to the long sides 84, 85 of the rectangular section, progressively increases on passing from the rectangular section to the circular section.

The shape of the internal surfaces of the body of the transition makes it possible to obtain curvatures, especially in the central portion of the transition, which are much larger than in the transitions of the prior art. This feature is manifested by a notable reduction in the electric field with the same transmitted RF power on the internal connection surfaces of the transition. The breakdown strength of the transition is thereby considerably improved.

In one particular embodiment of the transition shown in FIGS. 3*a*, 3*b*, 4*a*, 4*b*, the dimensions of the body of the transitions are:

length Lt=99 mm, along the ZZ' axis in FIG. 4*b;* the circular end 90 is of diameter D=205 mm in FIG. 4*a;* the conical internal surface 130 is that of a cone with an apex angle θ=135° in FIG. 4*b;* the internal rectangular section of the rectangular end 80 is of height H=82 mm and width L=165 mm in FIG. 4*a;* the planes Ph and Pb of the external surfaces inclined to the ZZ' axis, with an angle α=52° in FIG. 4*b*; and the radius of vertical curvature Rvc in the plane P3 perpendicular to the ZZ' axis and passing through this axis is 60 mm in FIG. 4*b*. This radius of vertical curvature Rvc is much higher than the fillet radius r of the transition of the prior art shown in FIG. 2, which is around 2 to 3 mm.

One of the main consequences of this novel type of transition according to the invention is that the pressurization gas in the waveguide and in the transition may be a non-greenhouse gas and harmless to maintenance personnel, such as air or nitrogen, while still obtaining a sufficient breakdown strength in the transition.

For example, for a delivered RF power of 5 MW output by the klystron operating in the L-band shown in FIG. 1 and a transition according to the invention, under an air pressure of 2 bar, the electric field on the plane internal surfaces 120, 122, 124, 126 of the rectangular sectional portion will be around 0.88 kV/mm. The electric field on the connecting surfaces 130, 132 will be around 0.94 kV/mm. This is an electric field level well below that (1.8 kV/mm) appearing at the connecting fillet 70 of the transition of the prior art shown in FIG. 2.

The specific profile with variable bidirectional radii of the transition according to the invention therefore makes it possible for the electric fields generated by passage of the microwave power in the form of a wave in this circuit (transition+WR650 waveguide) to be reduced sufficiently such that only air or nitrogen have to be used inside said circuit.

The advantage of using air as pressurizing gas is that maintenance is simpler and without hazard to personnel.

The transition according to the invention is also matched to the passage for the electromagnetic waves, resulting in an optimized reflection coefficient.

Figure 5:
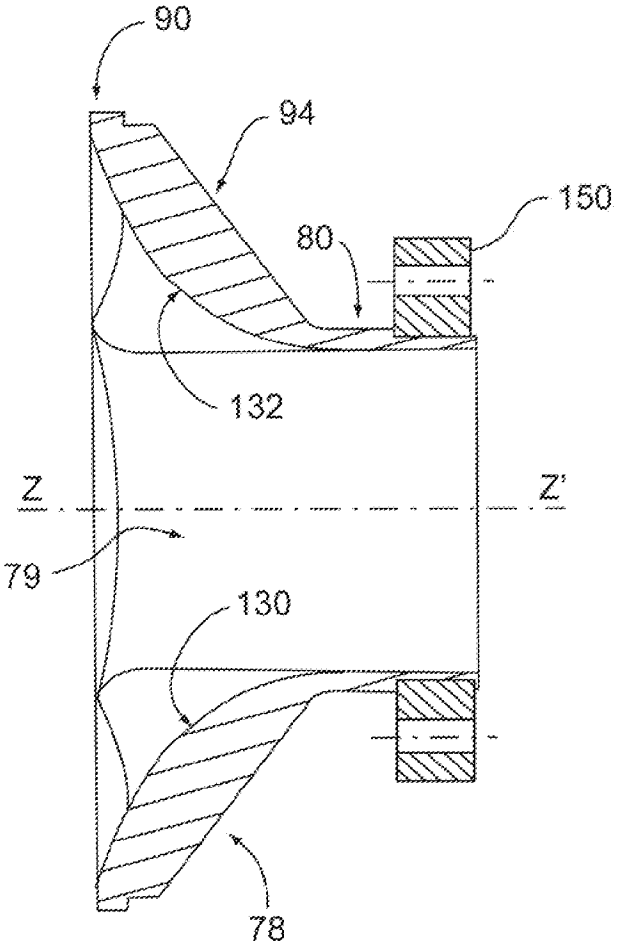
FIG. 5 shows an alternative form of a transition according to the invention, which includes a flange for connection to an application waveguide.

FIG. 5 shows an alternative form of a transition according to the invention, comprising the body 78 of the transition fastened to a flange 150 for connection to an application waveguide (not shown in the FIG. 5).

The flange 150, of same rectangular cross section as the waveguide, is fastened in a sealed manner to the rectangular end 80 of the body 78 of the transition.

Figure 6:
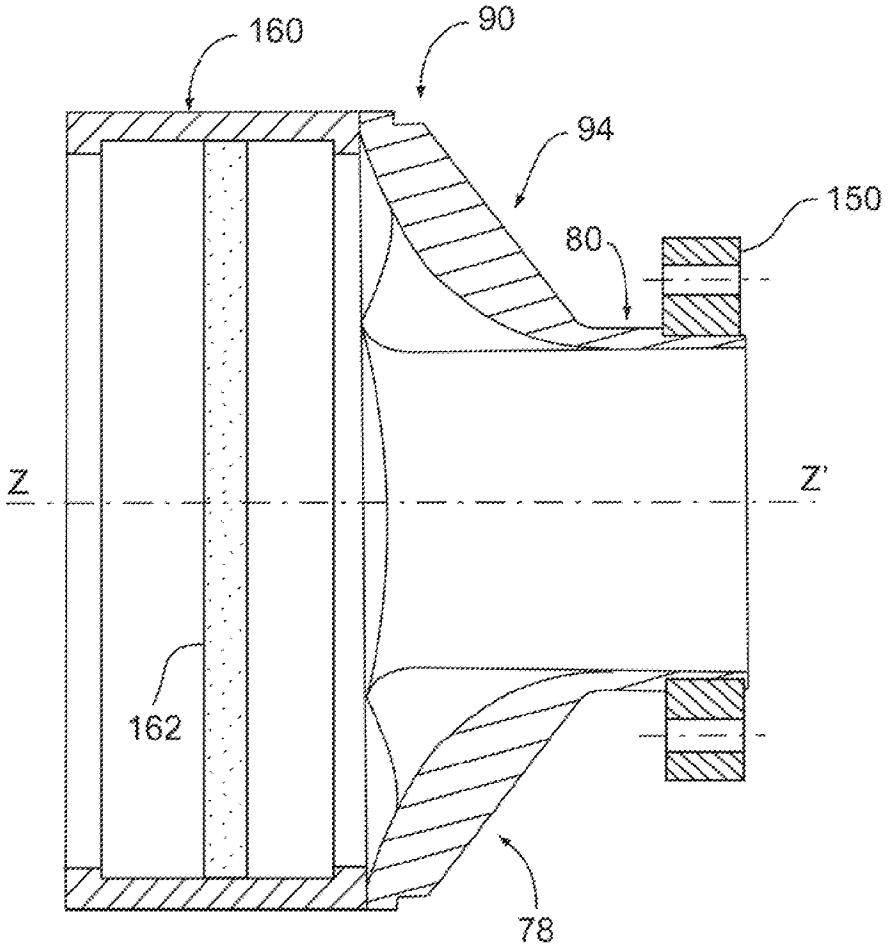
FIG. 6 shows another alternative form of the transition according to the invention, which includes a flange for connection to an application waveguide and a circular cylindrical separating window.

FIG. 6 shows another alternative form of the transition according to the invention, comprising a flange for connection to an application waveguide and a circular cylindrical separating window 160.

FIG. 6 shows another alternative form of the transition according to the invention comprising the connection flange 150 as shown in FIG. 5 fastened to the rectangular end 80 of the body 78 and a circular cylindrical separating window 160. The separating window 160 is coaxial with, of the same diameter as and fastened in a sealed manner to the circular portion 90 of the body 78.

The separating window 160 comprises a coaxial separating disk 162 made of a ceramic transparent to the electromagnetic waves, thereby separating two different physical media, on the one hand the vacuum in the electron tube and on the other hand the pressurized gas in the waveguide.

The flange 150 and the separating window 160 may be fastened to the body 78, for example by a brazing operation.

Figure 7:
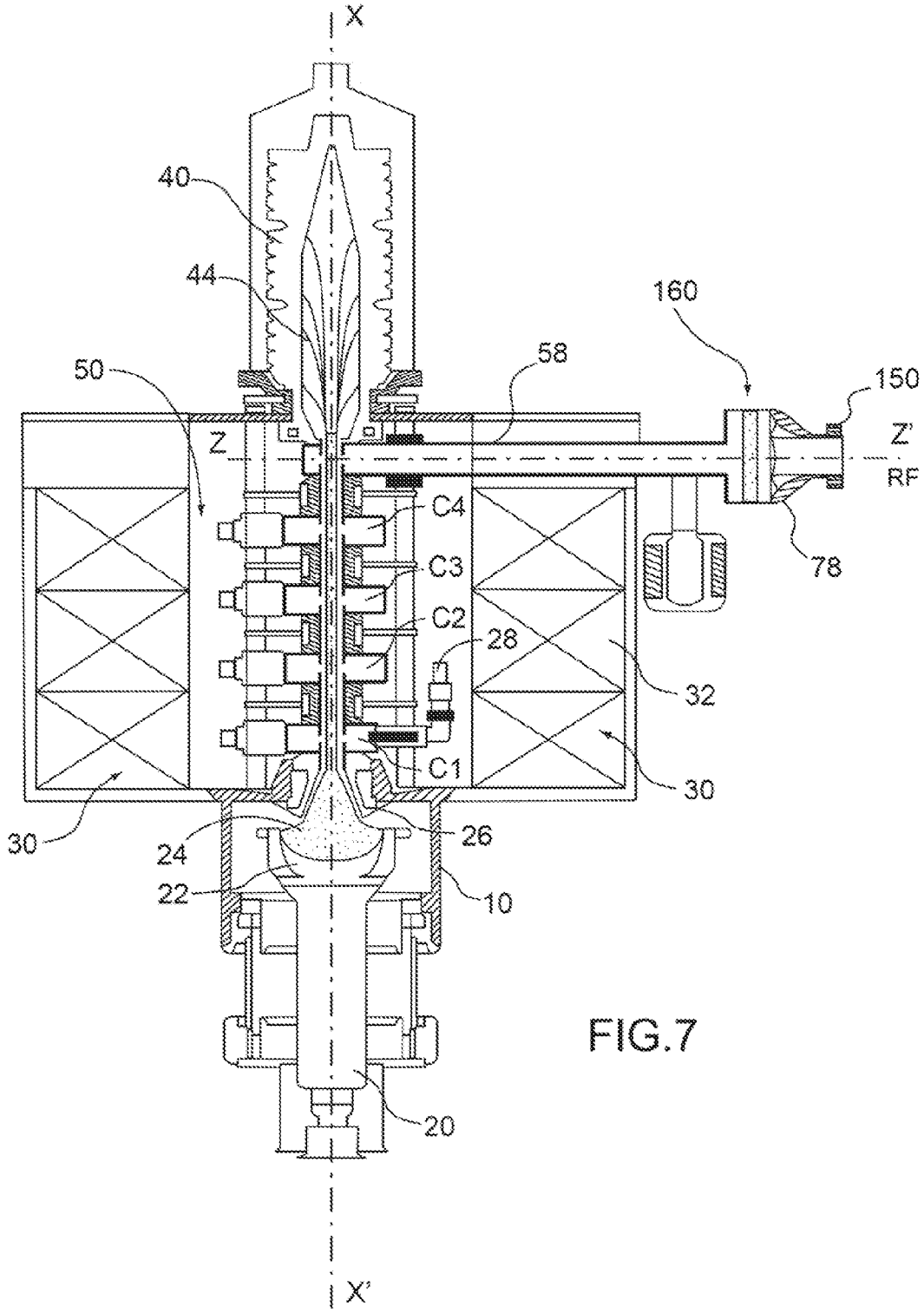
FIG. 7 shows the klystron of FIG. 1, which includes a transition according to the invention.

FIG. 7 shows the klystron of FIG. 1 that includes a transition according to the invention, according to the embodiment shown in FIG. 6.

In this embodiment of FIG. 6, the RF power output of the tube is connected in a sealed manner to the window 160 of the transition according to the invention. The application waveguide also includes a connection flange (not shown in the figure) also fastening it in a sealed manner to the transition on the side with its rectangular end via the flange 150 of the transition.

The invention claimed is:

1. A microwave output transition for an electron tube comprising a body of tubular shape, along a longitudinal axis, having two ends, a passage between the two ends that has internal surfaces for propagating electromagnetic waves, one of the ends, in the form of a circular cylindrical tube, comprising a conical internal propagation surface and the other end, in the form of a tube of rectangular cross section, having two long sides and two short sides perpendicular to the long sides, the passage comprising two planar internal propagation surfaces parallel to the long sides and two planar internal surfaces parallel to the short sides, wherein each of the planar internal propagation surfaces parallel to the long sides is joined to the conical internal propagation surface via a respective curved connecting surface defined by a plurality of radii of horizontal curvature and a plurality of radii of vertical curvature, wherein each of the radii of horizontal curvature rotates about a respective rotation axis parallel to the short sides of the rectangular end of the body and each of the radii of vertical curvature rotates about a respective rotation axis parallel to the long sides of said rectangular end of the body.

2. The microwave transition according to claim 1, wherein the respective curved surfaces for connecting the planar internal propagation surfaces that are parallel to the long sides to the conical internal propagation surface are symmetrical on either side of the longitudinal axis.

3. An electron tube comprising an RF output transition according to claim 1.

4. The microwave transition according to claim 1, wherein the radius of vertical curvature in a plane passing through the longitudinal axis of the body is longer than a first or a last radius of vertical curvature in a respective plane perpendicular to the long sides of the rectangular end passing through the planar internal propagation surfaces of the short sides of the rectangular section, the first and last radii of vertical curvature, which are equal in value, being the shortest of the radii of vertical curvature of internal surfaces for connection with the internal surfaces parallel to the long sides of the rectangular end.

5. The microwave transition according to claim 1, wherein the body of the transition includes a central portion between the end in the form of a tube of rectangular cross section and the end in the form of a circular cylindrical tube, said central portion having external surfaces in contact with a surrounding medium, two planar external connecting surfaces in respective inclined planes being symmetrical with respect to a plane passing through the longitudinal axis parallel to the long sides of the rectangular end of the body, and two planar external connecting surfaces that being symmetrical on either side of another plane passing through the longitudinal axis and that are parallel to the short sides of the rectangular end of the transition.

6. The microwave transition according to claim 1, wherein dimensions of the body of the transition are:

a length that is 99 mm along the longitudinal axis;

the circular end having a diameter of 205 mm;

the conical internal propagation surface being defined by a cone having an apex angle of 135°;

an internal rectangular section of the rectangular end having a height of 82 mm and a width of 165 mm; and a radius of vertical curvature in a plane perpendicular to the longitudinal axis and passing through the longitudinal axis being 60 mm.

7. The microwave transition according to claim 1, further comprising a connecting flange fastened to the rectangular cross section end of the body and a circular cylindrical separating window fastened to the circular end of the body.

8. The microwave transition according to claim 1, wherein the respective radii of horizontal and vertical curvature are of variable length.

9. The microwave transition according to claim 8, wherein the respective curved surfaces for connecting the planar internal propagation surfaces that are parallel to the long sides to the conical internal propagation surface are symmetrical on either side of the longitudinal axis.

* * * * *